US010421246B2

(12) United States Patent
Kurz et al.

(10) Patent No.: US 10,421,246 B2
(45) Date of Patent: Sep. 24, 2019

(54) MACHINE PRESS

(71) Applicant: HOERBIGER AUTOMATISIERUNGSTECHNIK HOLDING GMBH, Altenstadt (DE)

(72) Inventors: Manfred Kurz, Altenstadt (DE); Andreas Socher, Altenstadt (DE); Stefan Guth, Hohenfurch (DE)

(73) Assignee: HOERBIGER AUTOMATISIERUNGTECHNIK HOLDING GMBH, Altenstadt (DE)

( * ) Notice: Subject to any disclaimer, the term of this patent is extended or adjusted under 35 U.S.C. 154(b) by 1124 days.

(21) Appl. No.: 14/584,332

(22) Filed: Dec. 29, 2014

(65) Prior Publication Data

US 2015/0107466 A1 Apr. 23, 2015

Related U.S. Application Data

(63) Continuation of application No. PCT/EP2013/001678, filed on Jun. 7, 2013.

(30) Foreign Application Priority Data

Jun. 30, 2012 (DE) ..... 10 2012 013 098

(51) Int. Cl.
*B30B 15/16* (2006.01)
*F15B 1/26* (2006.01)

(52) U.S. Cl.
CPC ..... *B30B 15/163* (2013.01); *B30B 15/165* (2013.01); *F15B 1/265* (2013.01);
(Continued)

(58) Field of Classification Search
CPC ..... B30B 15/165; B30B 15/163; F15B 1/265; F15B 2211/20515; F15B 2211/20569; F15B 2211/625; F15B 2211/7055
(Continued)

(56) References Cited

U.S. PATENT DOCUMENTS 2,413,876 A * 1/1947 Lefler ..... B30B 15/165 60/400
3,669,151 A 6/1972 Fleming
(Continued)

FOREIGN PATENT DOCUMENTS

DE 698293318 T2 7/2005
DE 102009052531 A1 5/2011
(Continued)

OTHER PUBLICATIONS

International Search Report for corresponding PCT Application No. PCT/EP2013/001678, dated Aug. 23, 2013.
(Continued)

*Primary Examiner* — Jimmy T Nguyen
(74) *Attorney, Agent, or Firm* — Myers Wolin, LLC

(57) ABSTRACT

In a machine press with a lower and an upper tool support, a closed hydraulic drive system acts upon the upper tool support. This system has at least one hydraulic drive unit, which includes at least one hydraulic cylinder-piston unit and at least one hydraulic assembly acting upon this unit and supplied from a storage reservoir. A base pressure above environmental pressure constantly prevails in the storage reservoir. The storage reservoir is designed as a cylinder store with a hydraulic chamber defined by a cylinder and a piston unit displaceably guided therein. The piston unit is acted upon on its side functionally opposite the hydraulic chamber by a hydraulic fluid chamber which for its part is connected to a high-pressure gas store. The active surface of the hydraulic fluid chamber on the piston unit is small compared to the active surface of the hydraulic chamber on the piston unit.

11 Claims, 4 Drawing Sheets

(52) U.S. Cl.
CPC ..... *F15B 2211/20515* (2013.01); *F15B 2211/20569* (2013.01); *F15B 2211/625* (2013.01); *F15B 2211/7055* (2013.01)

(58) Field of Classification Search
USPC ..... 100/269.01, 269.05, 269.14
See application file for complete search history.

(56) References Cited

U.S. PATENT DOCUMENTS 4,022,096 A * 5/1977 Forichon ..... B23D 15/14 100/269.05
4,152,921 A * 5/1979 Dits ..... B21J 9/20 72/441
4,209,987 A * 7/1980 Kononov ..... B30B 1/23 100/269.05
4,777,800 A * 10/1988 Hay, II ..... B63C 11/52 137/236.1
7,520,129 B2 * 4/2009 Springett ..... E21B 33/0355 60/398
8,074,557 B2 * 12/2011 Kurz ..... F15B 9/10 91/378
2003/0167936 A1 9/2003 Hahn
2012/0272840 A1 11/2012 Kurz et al.

FOREIGN PATENT DOCUMENTS

JP S59092198 A 5/1984
WO 2011057773 A2 5/2011
WO 2011115523 A1 9/2011

OTHER PUBLICATIONS

International Preliminary Report on Patentability in corresponding PCT Application No. PCT/EP2013/001678, dated Jun. 10, 2014.

* cited by examiner

MACHINE PRESS

CROSS REFERENCE TO RELATED APPLICATIONS

This application is a continuation under 35 U.S.C. § 120 of International Application PCT/EP2013/001678, filed Jun. 7, 2013, which claims priority to German Application 10 2012 013 098.8, filed Jun. 30, 2012, the contents of each of which are incorporated by reference herein.

FIELD OF THE INVENTION

The present invention relates to a machine press, especially a folding press, with a machine structure, a lower tool support disposed in fixed spatial relationship with the machine structure, an upper tool support, which is linearly movable up and down by an operating stroke relative to the lower tool support, and a closed hydraulic drive system, which acts on the upper tool support to cause the downwardly directed movement of the upper tool support and which is provided with at least one hydraulic drive unit, which in turn comprises at least one hydraulic cylinder-piston unit and at least one hydraulic assembly that urges this and is supplied from a storage reservoir, wherein a base pressure higher than environmental pressure prevails constantly in the storage reservoir.

BACKGROUND

Such machine presses are known and in service in diverse constructions and configurations. For example, DE 102009052531 A1 discloses a machine press of the class in question.

There is further known, specifically from DE 69829318 T2, a hydraulic system intended for a press, for example a baling press, in which a main press cylinder with a primary side for generating pressing force and a device for retracting a press ram are associated with the press ram. This device for retracting the press ram is operated from a (second) open hydraulic circuit, from which there is also operated a pressure booster, by means of which the (first) closed hydraulic circuit in communication with the primary side of the main press cylinder is maintained constantly under an overpressure.

The present invention is oriented toward providing a machine press of the class in question optimized with respect to essential aspects relevant to practice, wherein the aspects relate specifically to the design size and the structural complexity—and thus also the manufacturing costs.

SUMMARY

The object according to the present invention as described in the foregoing is achieved by the fact that the storage reservoir in a machine press of the class in question is constructed as a cylinder accumulator with a hydraulic chamber bounded by a cylinder and a piston unit guided displaceably therein, wherein the piston unit is urged on its side disposed functionally opposite to the hydraulic chamber by a pressurized fluid chamber, which in turn is in communication with a high-pressure gas accumulator and the active face of which on the piston unit is small compared with the active face of the hydraulic chamber on the piston unit. Specifically, significant advantages compared with the prior art can be achieved in this way in particularly large and powerful machine presses; after all, even in machine presses with a relatively large required alternating volume, which in inventive machine presses is defined by the difference between the maximum and minimum volumes of the hydraulic chamber of the cylinder accumulator, it is possible to ensure with a relatively small high-pressure gas accumulator that a base pressure higher than the environmental pressure reliably prevails constantly in the at least one hydraulic drive unit, i.e. over all operating phases of the machine press. In this sense the high-pressure gas accumulator provided according to the present invention can operate successfully with a fraction of that design size exhibited by the pressure accumulator provided according to DE 102009052531 A1. Even the chamber requirement for the cylinder accumulator and the high-pressure gas accumulator together is still always much smaller than the chamber requirement for the pressure accumulator of the machine press of the class in question, and a further advantage is achieved in that, because of the spatial separation of cylinder accumulator and high-pressure gas accumulator possible within the scope of the present invention, increased flexibility exists with regard to the use of chamber, with the option of particularly compactly constructed hydraulic drive systems. In a specific implementation of the present invention, for example with a high-pressure gas accumulator having a volume of approximately 0.3 to 0.5 L, a hydraulic drive unit with an alternating volume on the order of 10 L can be held constantly at a base pressure between 2 and 3 bar, wherein the active face of the hydraulic chamber on the piston unit in such a case is typically larger by a factor between 50 and 150, particularly typically by a factor between 75 and 100, than the active face of the high-pressure gas accumulator on the piston unit.

Depending on the specific circumstances, the present invention can be technically implemented in the most diversely engineered construction variants. In this sense a first preferred improvement of the present invention is characterized in that the pressurized-fluid chamber is disposed—preferably centrally—inside the piston unit, and specifically in such a way that it is sealed relative to the cylindrical outer face of a plunger tube, which penetrates more or less deeply therein and is in communication with the high-pressure gas accumulator. This hydraulic chamber may be bounded in particular by the complete end face of the piston unit. According to one modification, the pressurized-fluid chamber may be provided (as a cylindrical cavity) inside a projection provided on the piston unit and protruding into the hydraulic chamber, in which case the pressurized-fluid chamber is bounded by a piston element guided sealingly in the said cylindrical cavity. If necessary, this pressurized-fluid chamber may be of annular construction.

Furthermore, a considerable margin for configuration exists inasmuch as the gas compressed in the high-pressure gas accumulator can act either directly on the piston unit or else indirectly—by an intermediate circuit of a liquid active medium. In other words, either the gas of the high-pressure gas accumulator or else a liquid pressurized fluid can be present in the pressurized-fluid chamber of the cylinder accumulator, thus functioning to transmit the pressure prevailing in the high-pressure gas accumulator to the pressurized-fluid chamber and to urge the piston unit accordingly.

Incidentally, the feature according to the claims, whereby the pressurized-fluid chamber urging the piston unit of the cylinder accumulator is in communication with a high-pressure gas accumulator, should not be understood to mean that the pressurized-fluid chamber and the high-pressure gas accumulator are two spatially separated volumes. To the contrary, it is also entirely possible to achieve an engineered implementation of the present invention by the fact that the pressurized-fluid chamber is provided inside the cylinder accumulator on the side of the piston unit facing functionally away from the hydraulic chamber-mounted spatially therein if necessary—and at the same time the volume of the high-pressure gas accumulator (or at least part thereof) forms a common gas-filled cavity on its own or together therewith. In this regard, reference is made—for structural details—to the explanation of one of the exemplary embodiments illustrated in the drawing.

According to yet another preferred improvement of the present invention, the high-pressure gas accumulator also performs a further function of the inventive machine press, namely by the fact that it is identical with a gas spring, which urges a return-stroke working chamber of the associated drive unit. By such integration of several functions in a single structural component of the drive system, not only is it possible—in the sense of a particularly compact drive system—to reduce the necessary chamber requirement, but also it is possible to save costs in this way.

BRIEF DESCRIPTION OF THE DRAWINGS

The present invention will be explained hereinafter on the basis of four hydraulic drive units, just as they may be components of preferred embodiments of inventive machine presses, illustrated more or less schematically by way of example in the drawing, wherein.

DETAILED DESCRIPTION OF THE PREFERRED EMBODIMENTS

Figure 1:
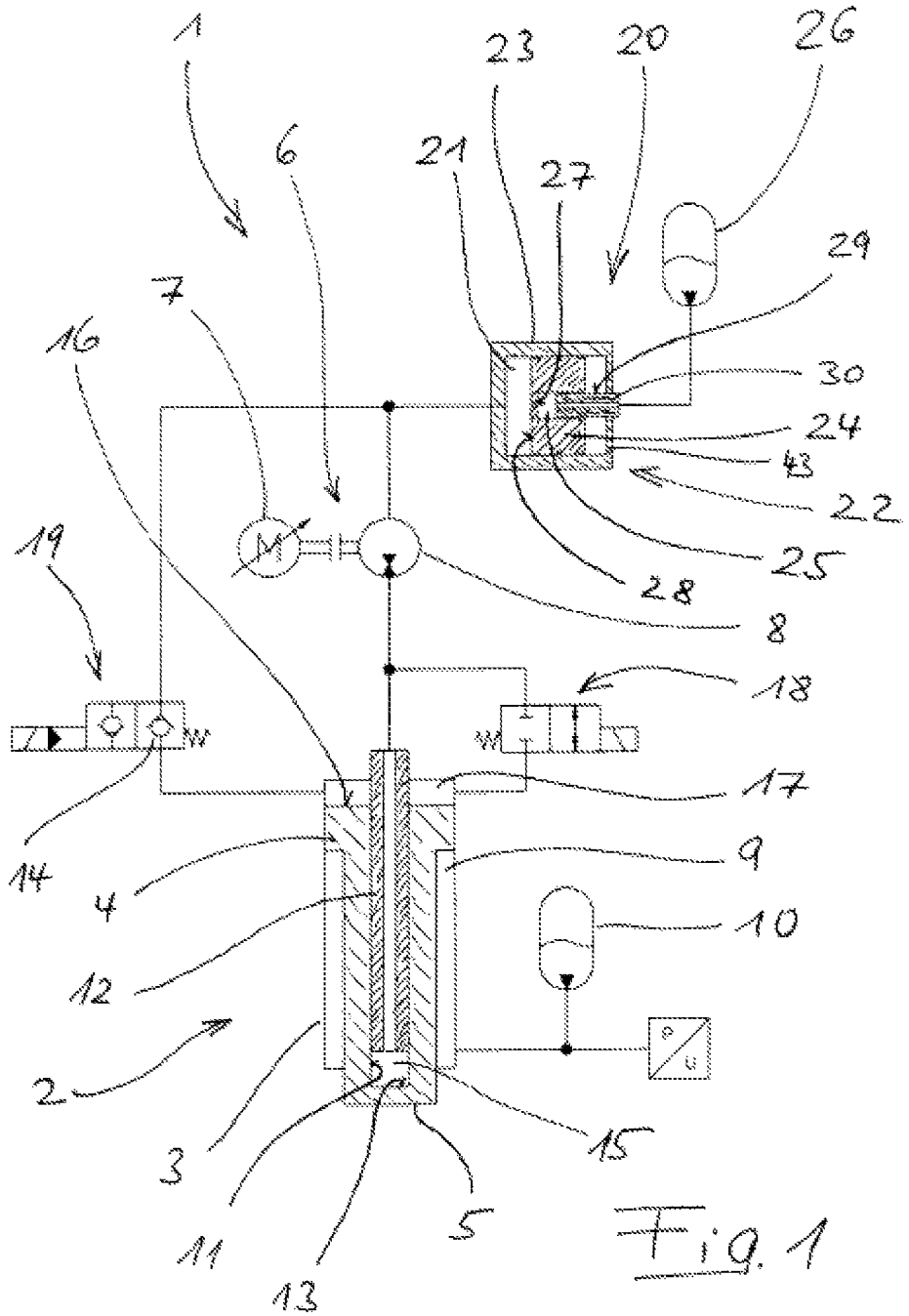
FIG. 1 shows a first preferred exemplary embodiment of such a hydraulic drive unit.

The drawing is not intended to represent the machine press as a whole, and it is limited to reproducing the aspects that are important for the present invention while relating to the respective drive system. Thus the machine presses for which the exemplary embodiments of the drive system explained in more detail hereinafter are intended may correspond in terms of their fundamental structure especially to the prior art (see, for example, DE 102009052531 A1).

The closed hydraulic drive system acting on the upper tool support of the machine press in order to bring about its downwardly directed movement respectively comprises at least one hydraulic drive unit 1. Typically the drive system in question of each machine press respectively comprises two of the illustrated drive units, and so the description hereinafter will focus on this alternative.

Each of the two drive units 1 comprises in turn a hydraulic cylinder-piston unit 2—although if necessary several cylinder-piston units 2 may also be provided—with a cylinder 3 and, guided therein, a piston 4, the piston rod 5 of which is firmly joined to the upper tool support of the machine press, as well as a hydraulic assembly 6 that urges hydraulic cylinder piston unit 2 and has a hydraulic pump 8 driven (reversibly with respect to the direction of rotation) by an electric motor 7 and constructed as a reversing pump.

The upper tool support is held in its upper end position by means of a spring device that applies preloading. The spring device is integrated in such a way into hydraulic cylinder-piston unit of the two drive units 1 that respective piston-rod working chamber 9 of hydraulic cylinder-piston units 2 is in hydraulic communication with an associated external pressure accumulator 10 subjected to gas preloading.

The hydraulic drive of the machine press can be changed over between a fast traverse and a press traverse. In this connection—because the upwardly directed force of the spring device (described in the foregoing) is acting constantly at such a height on the upper tool support that its weight and all movable components of the machine press coupled therewith as well as the closing force involved by the base pressure prevailing in the two hydraulic drive units (see below) is over-compensated and the upper tool support is held in its highest position by preloading—an active movement of the upper tool support by the hydraulic drive is nevertheless not a free movement due to gravity, even in the fast traverse. This is achieved by the fact that a respective auxiliary piston 12 penetrates into pistons 4 of the two hydraulic cylinder-piston units 2, namely into respective bores 11 machined therein. More information in this regard may be found in AT 8633 U1 (FIGS. 3 and 4 together with associated description) and DE 102009052531 A1. As a result, a relatively small first active piston face 13 is urged by hydraulic assembly 6 in the fast traverse, whereas a substantially larger, second active piston face, which is composed of the first active piston face 13 of auxiliary working chamber 15 and annular face 16 of piston working chamber 17, is urged in the press traverse. Changeover between the fast traverse and the press traverse is achieved by means of valve 18, which shuts off the communication of hydraulic assembly 6 with piston working chamber 17 in the fast traverse but in contrast opens during the press traverse. During the fast traverse, piston working chamber 17 becomes filled via the path of suction valve 19 protected by check valve 14.

For the press traverse, valve 18 is changed over, so that hydraulic assembly 6 urges piston working chamber 17 and auxiliary working chamber 15 in parallel. At the end of the closing movement, i.e. typically when the upper tool support has reached a given position, the flow of hydraulic assembly 6 is powered down and stopped, so that the upper tool support becomes stationary. The tool then pauses for a short time, before what is known as the "decompression stroke" sets in, i.e. the slow, controlled raising of the upper tool and opening of the press by a small distance (e.g. 2-3 mm) due to reversal of the flow direction in the hydraulic assembly. At the end of the decompression stroke, i.e. when the high pressure in cylinder-piston unit 2 has been reduced at least substantially, valve 18 and suction valve 19 are changed over, so that piston 4 is retracted under the effect of the spring device. This retraction of piston 4 takes place in a controlled (braked) fast traverse, in which auxiliary working chamber 15 is emptied in monitored and controlled manner via hydraulic assembly 6, which continues to be operated with flow direction reversed compared with closing of the press. To this extent the output capacity of hydraulic assembly 6 can be changed over and adjusted in this hydraulic drive unit.

The hydraulic system is hermetically sealed. For this purpose a storage reservoir 20, which has a volume-variable hydraulic chamber (storage chamber) 21, wherein the maximum volume difference of storage chamber 21 is matched to the alternating volume of hydraulic cylinder-piston unit 2, is provided for the hydraulic fluid.

The hydraulic fluid is pressurized in such a way in the hydraulic system that at least a base pressure higher than the environmental pressure prevails constantly therein and everywhere—and therefore especially in storage chamber 21. For this purpose, and in engineered implementation of the present invention, storage reservoir 20 is constructed in all exemplary embodiments as cylinder accumulator 22 with a storage chamber (hydraulic chamber) 21 bounded by a cylinder 23 and a piston unit 24 guided displaceably therein. On its side functionally facing hydraulic chamber 21, piston unit 24 is urged by a pressurized-fluid chamber 25. This in turn is in communication with a high-pressure gas accumulator 26. Active face 27 of pressurized-fluid chamber 25 on piston unit 24 is small relative to active face 28 of hydraulic chamber 21 on piston unit 24.

In the embodiment shown in FIG. 1, pressurized-fluid chamber 25 is disposed centrally inside piston unit 24. It is sealed relative to cylindrical outside face 29 of a plunger tube 30, which penetrates more or less deeply therein and which is in communication with high-pressure gas accumulator 26. High-pressure gas accumulator 26 is constructed as a hydraulic accumulator, the oil side of which is in communication with pressurized-fluid chamber 25. Via a corresponding vent opening 43, environmental pressure prevails on the back side of piston unit 24. Hydraulic chamber 21 is bounded by the complete end face 28 of piston unit 24.

Figure 2:
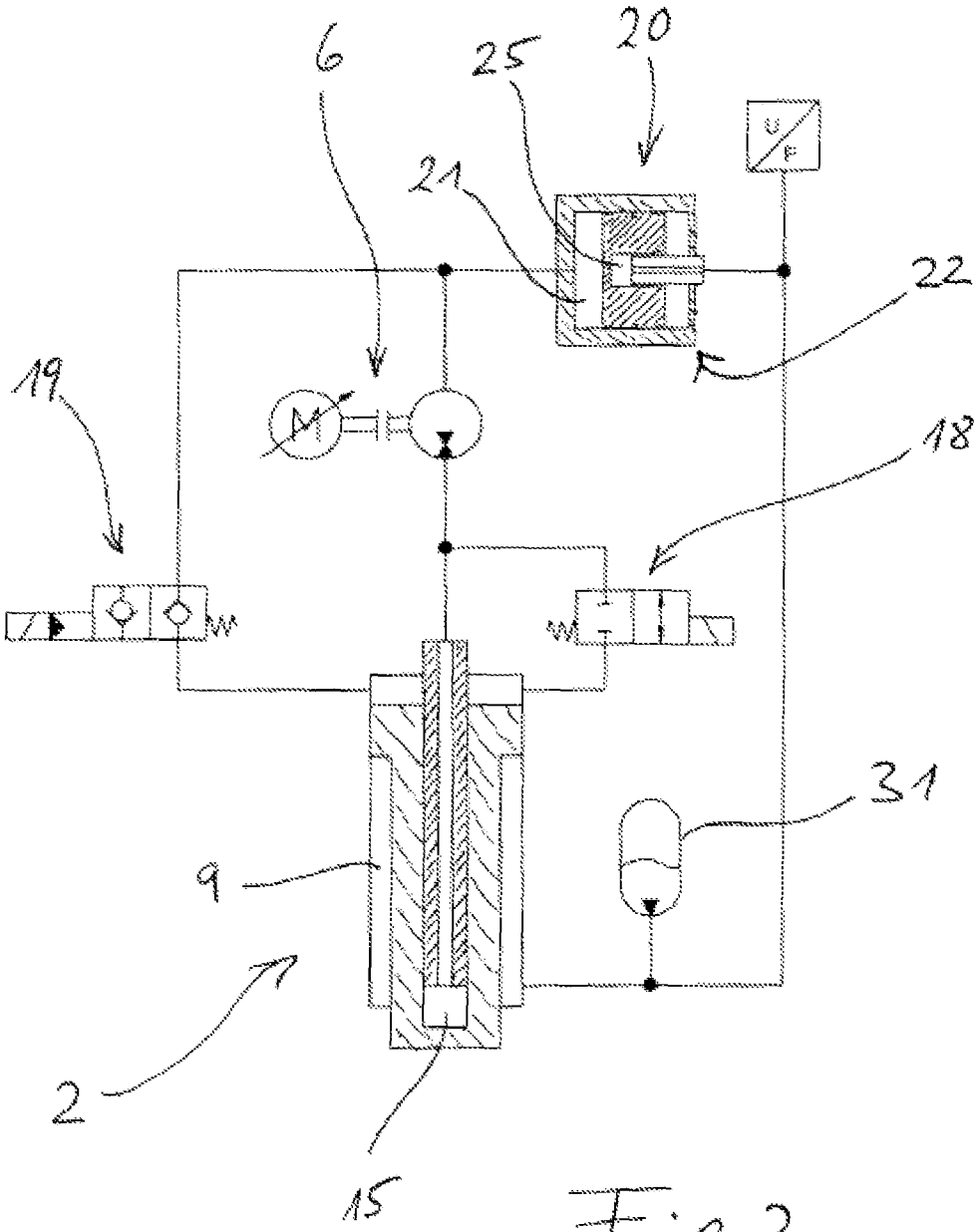
FIG. 2 shows a second preferred exemplary embodiment of such a hydraulic drive unit.

According to FIG. 2, hydraulic drive unit 1 illustrated in FIG. 1 and explained in the foregoing is modified in such a way as to provide a single high-pressure gas accumulator 31, which by itself unites the functions of the two high-pressure gas accumulators 10 and 26 according to the exemplary embodiment according to FIG. 1. Thus high-pressure gas accumulator 31 not only is functionally associated with storage reservoir 20 but also is part of the—hydropneumatically constructed—spring device, by the fact that it also urges piston-rod working chamber (return-stroke working chamber) 9.

Figure 3:
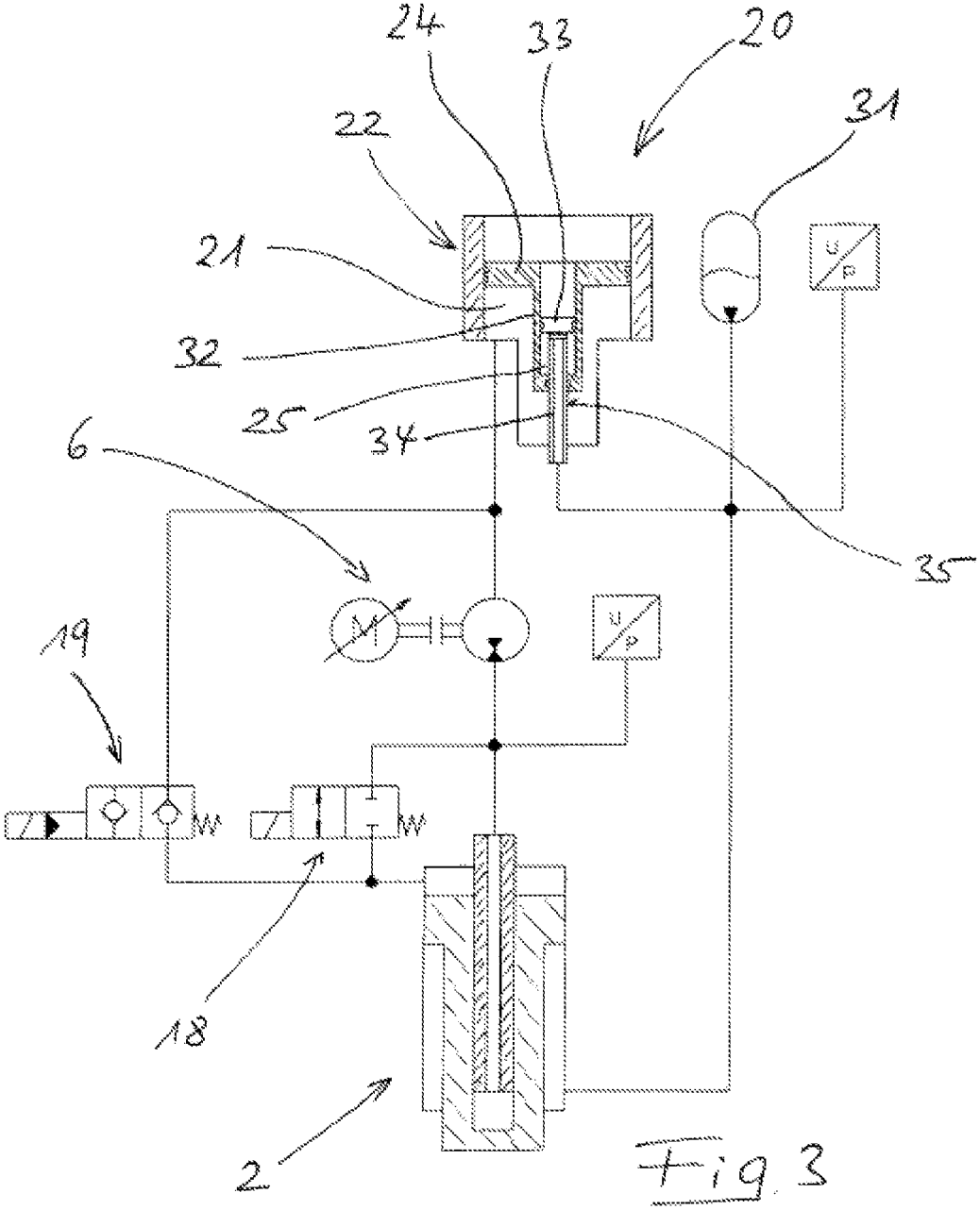
FIG. 3 shows a third preferred exemplary embodiment of such a hydraulic drive unit and FIG. 4 shows a fourth preferred exemplary embodiment of such a hydraulic drive unit.

According to FIG. 3, hydraulic drive unit 1 illustrated in FIG. 2 and explained in the foregoing is modified in such a way with respect to storage reservoir 20 that pressurized-fluid chamber 25 is disposed as a cavity inside a projection 32 provided on piston unit 24 and prolonging it. This projection 32 penetrates into hydraulic chamber 21, which in turn is provided with a corresponding extension. Pressurized-fluid chamber 25 is bounded by a sealing piston 33 guided sealingly in the said cavity. In this case sealing piston 33 is disposed at the end face on a plunger tube 34, which passes through pressurized-fluid chamber 25 (which for this reason is annular) and is sealed relative to its cylindrical outside face 35 of projection 32 of piston unit 24. High-pressure gas accumulator 31 is connected to plunger tube 34 and via this urges pressurized-fluid chamber 25.

Figure 4:
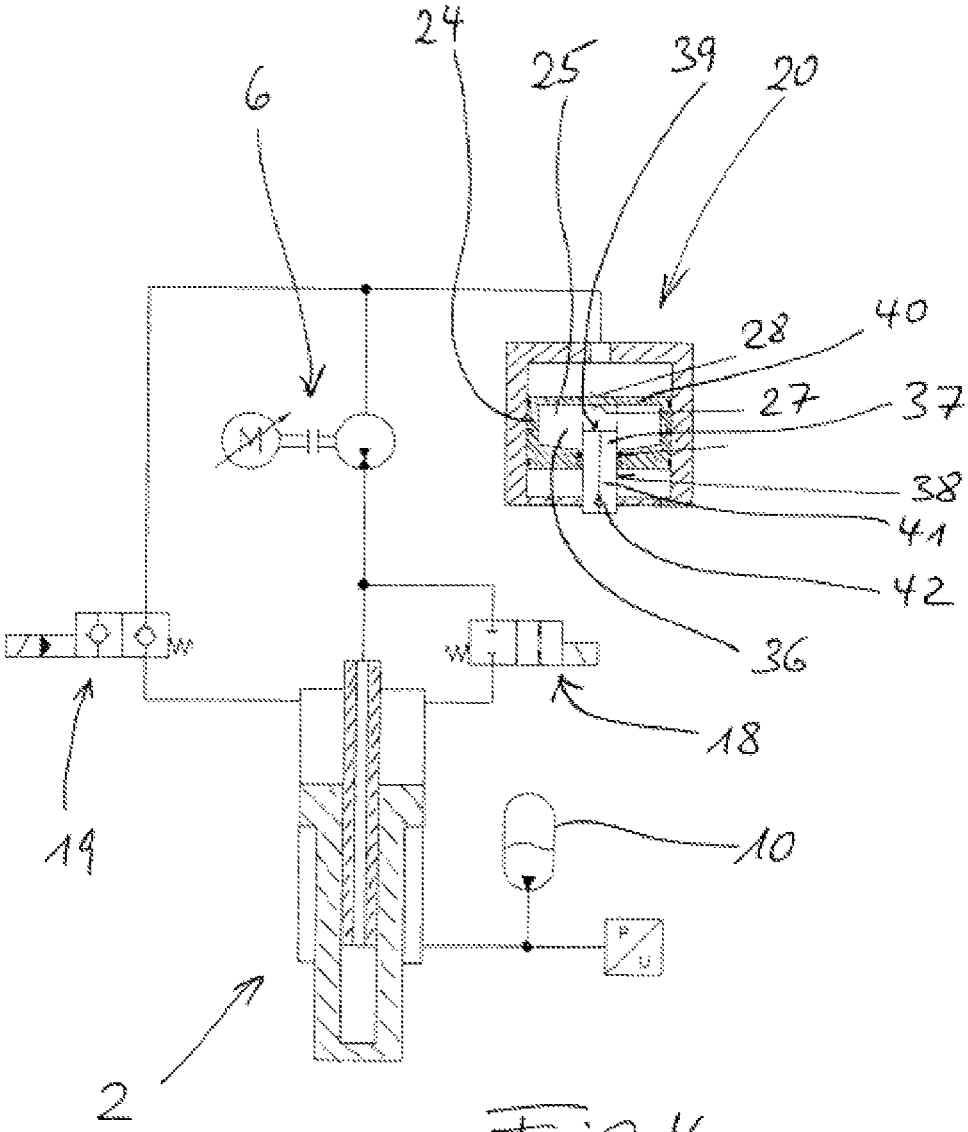

According to FIG. 4, hydraulic drive unit 1 illustrated in FIG. 1 and further explained hereinabove is modified in such a way with respect to storage reservoir 20 that high-pressure gas accumulator 36, by virtue of the pressure preloading of which the hydraulic system is constantly impressed with a base pressure at least higher than the environmental pressure, is disposed inside cylinder accumulator 22, namely inside piston unit 24. Pressurized-fluid chamber 25 and the gas chamber of high-pressure gas accumulator 36 therefore merge into one another, i.e. they form—as a cavity disposed in piston unit 24—a spatially and functionally indivisible unit. A plunger spigot 37 joined firmly to the cylinder of storage reservoir 20 penetrates—depending on the position of the piston unit—more or less deeply into the cavity, which is sealed relative to cylindrical outside face 38 of plunger spigot 37. The active face of high-pressure gas accumulator 36 on piston unit 24 corresponds in this embodiment to the portion of end wall 40 of the piston unit bounding the cavity and disposed opposite end face 39 of plunger spigot 37. A filling duct 41 in plunger spigot 37 is provided with a check valve 42, in order to be able to compensate for a possible leak of the compressed gas pressurized in the cavity.

It must be pointed out for clarification that the illustration of the exemplary embodiments explained in the foregoing with diverse detailed features is in no case to be construed as a correspondingly limited disclosure of the present invention, and certainly not even in such a way that the respective individual features are respectively disclosed only in such a combination with one another. To the contrary, other detailed features and/or other combinations of features are encompassed by the present invention. For example, the specific (hydropneumatic) construction of the device for the return stroke of the upper tool support is in no way mandatory. To the contrary, all other known return-stroke devices functioning, for example, hydraulically, mechanically, electrically, pneumatically or in some other way may be provided. No more so is it mandatory that the upper tool support of the machine press can be lowered at all with two different speeds, i.e. in a fast traverse and a press traverse, but if it can, that a combined hydraulic cylinder according to the illustrated design must be used for the purpose. Diverse other known configurations that permit two-stage lowering of the upper tool support are obviously also usable in the scope of the present invention.

What is claimed is:

1. A machine press with a machine structure, a lower tool support disposed in fixed spatial relationship with the machine structure, an upper tool support, which is linearly movable up and down by an operating stroke relative to the lower tool support, and a closed hydraulic drive system, which acts on the upper tool support to cause the downwardly directed movement of the upper tool support and where the closed hydraulic drive system is provided with at least one hydraulic drive unit (1), which in turn comprises at least one hydraulic cylinder-piston unit (2) and at least one hydraulic assembly (6) that urges the hydraulic cylinder-piston unit, where a storage reservoir provides hydraulic fluid to the hydraulic assembly, wherein a base pressure higher than environmental pressure prevails constantly in the storage reservoir, wherein:

the storage reservoir (20) is constructed as a cylinder accumulator (22) with a hydraulic chamber (21) bounded by a cylinder (23) and a piston unit (24) guided displaceably therein, wherein the piston unit is urged on its side disposed functionally opposite to the hydraulic chamber by a pressurized fluid chamber (25), which in turn is in communication with a high-pressure gas accumulator (26, 31, 36) and an active face (27) of the fluid chamber on the piston unit is small compared with an active face (28) of the hydraulic chamber (21) on the piston unit (24).

2. The machine press of claim 1, wherein a ratio of the active faces (28; 27) of the hydraulic chamber (21) and of the pressurized-fluid chamber (25) on the piston unit (24) is between 50 and 150.

3. The machine press of claim 1, wherein the pressurized-fluid chamber (25) is disposed inside the piston unit (24).

4. The machine press of claim 3, wherein the pressurized-fluid chamber (25) is sealed relative to a cylindrical outer face (29) of a plunger tube (30), which penetrates more or less deeply therein and is in communication with the high-pressure gas accumulator (26).

5. The machine press of claim 1, wherein the pressurized-fluid chamber (25) is disposed as a cavity inside a projection (32) provided on the piston unit (24) and prolonging it.

6. The machine press of claim 5, wherein a projection (32) protrudes into the hydraulic chamber (21).

7. The machine press of claim 5, wherein the pressurized-fluid chamber (25) is bounded by a sealing piston (33) guided sealingly in the cavity.

8. The machine press of claim 7, wherein the sealing piston (33) is disposed at the end face on a plunger tube (34), which passes through the pressurized-fluid chamber (25) and is sealed relative to its cylindrical outside face (35) of the projection (32) of the piston unit (24).

9. The machine press of claim 1, wherein the high-pressure gas accumulator (26) is constructed as a hydraulic accumulator, wherein an oil side of the hydraulic accumulator is in communication with the pressurized-fluid chamber (25).

10. The machine press of claim 1, wherein a hydropneumatically constructed return-stroke spring device acts on the upper tool support, wherein a gas spring of the spring device is identical to the high-pressure gas accumulator (31).

11. The machine press of claim 1, wherein the pressurized-fluid chamber (25) is provided inside the cylinder accumulator (22) on the side of the piston unit (24) facing away from the hydraulic chamber (21), and at the same time forms the volume of the high-pressure gas accumulator (36).

* * * * *